US007294141B2

(12) United States Patent
Bergersen

(10) Patent No.: US 7,294,141 B2
(45) Date of Patent: Nov. 13, 2007

(54) PACIFIER, A SYSTEM AND A METHOD FOR MAINTAINING PROPER DENTITIONS

(75) Inventor: Earl O. Bergersen, Dorado, PR (US)

(73) Assignee: Ortho-Tain, Inc., Toa Alta, PR (US)

( * ) Notice: Subject to any disclaimer, the term of this patent is extended or adjusted under 35 U.S.C. 154(b) by 670 days.

(21) Appl. No.: 10/665,458

(22) Filed: Sep. 18, 2003

(65) Prior Publication Data

US 2004/0059382 A1 Mar. 25, 2004

Related U.S. Application Data

(60) Provisional application No. 60/412,454, filed on Sep. 20, 2002.

(51) Int. Cl.
*A61J 17/00* (2006.01)

(52) U.S. Cl. ..... 606/236; 606/234

(58) Field of Classification Search ..... None
See application file for complete search history.

(56) References Cited

U.S. PATENT DOCUMENTS

| | | | | |
|---|---|---|---|---|
| 516,561 | A * | 3/1894 | Bosch | 606/235 |
| 3,129,709 | A * | 4/1964 | Rountree | 606/236 |
| 3,448,738 | A * | 6/1969 | Berghash | 128/861 |
| 3,669,117 | A * | 6/1972 | Herbst | 606/235 |
| 3,724,075 | A | 4/1973 | Kesling | |
| 3,837,081 | A | 9/1974 | Kesling | |
| 4,073,061 | A | 2/1978 | Bergersen | |
| 4,105,032 | A | 8/1978 | Blomstedt | |
| 4,139,944 | A | 2/1979 | Bergersen | |
| 4,370,129 | A | 1/1983 | Huge | |
| 4,371,336 | A | 2/1983 | Hilleman | |
| 4,396,373 | A | 8/1983 | Dellinger | |
| 4,568,280 | A | 2/1986 | Ahlin | |
| 4,591,341 | A | 5/1986 | Andrews | |

(Continued)

FOREIGN PATENT DOCUMENTS

| | | |
|---|---|---|
| DE | 70 949 | 11/1892 |

(Continued)

OTHER PUBLICATIONS

International Preliminary Examination Report for International Application No.: PCT/US03/29665 mailed on Jan. 7, 2005.

*Primary Examiner*—Glenn K. Dawson
(74) *Attorney, Agent, or Firm*—Patents+TMS, P.C.

(57) ABSTRACT

A pacifier, a system and a method for maintaining proper dentitions in a child are provided. The pacifier may have a bulb which is connected to an external shield by an isthmus. A child may suck on the bulb when the pacifier is worn in the mouth. The isthmus connecting the bulb and the external shield may be flat. Moreover, the isthmus may have a thickness which may be less than a thickness of known connectors, and may be wider from side-to-side than connectors associated with known pacifiers which connect a bulb and an external shield. As a result, the pacifier may prevent the child from developing, for example, an open bite or other malocclusion. The pacifier may or may not incorporate a thickened pillow to aid in the reduction of pain associated with teething.

37 Claims, 5 Drawing Sheets

U.S. PATENT DOCUMENTS

| | | | | | |
|---|---|---|---|---|---|
| 4,688,571 | A | * | 8/1987 | Tesler | 606/234 |
| 4,784,605 | A | | 11/1988 | Bergersen | |
| 4,799,884 | A | | 1/1989 | Bergersen | |
| 4,830,612 | A | | 5/1989 | Bergersen | |
| 4,898,535 | A | | 2/1990 | Bergersen | |
| 4,919,612 | A | | 4/1990 | Bergersen | |
| 4,983,334 | A | | 1/1991 | Adell | |
| 4,986,751 | A | | 1/1991 | Bergersen | 433/6 |
| 5,007,924 | A | * | 4/1991 | Jekel | 606/234 |
| 5,028,231 | A | | 7/1991 | Hall | |
| 5,037,294 | A | | 8/1991 | Bergersen | |
| 5,037,295 | A | | 8/1991 | Bergersen | |
| 5,042,506 | A | | 8/1991 | Liberati | |
| D323,215 | S | | 1/1992 | Bergersen | |
| 5,160,344 | A | * | 11/1992 | Werton | 606/235 |
| 5,284,490 | A | * | 2/1994 | Green | 606/235 |
| 5,328,362 | A | | 7/1994 | Watson et al. | |
| 5,334,218 | A | * | 8/1994 | Johnson | 606/235 |
| 5,338,190 | A | | 8/1994 | Tregillis | |
| 5,620,011 | A | * | 4/1997 | Flowers | 128/859 |
| 5,645,420 | A | | 7/1997 | Bergersen | |
| 5,666,974 | A | * | 9/1997 | Hiro et al. | 128/861 |
| 5,683,244 | A | | 11/1997 | Truax | |
| 5,779,470 | A | | 7/1998 | Kussick | |
| 5,810,000 | A | * | 9/1998 | Stevens | 128/200.26 |
| 5,814,074 | A | * | 9/1998 | Branam | 606/234 |
| 5,816,799 | A | | 10/1998 | Parker | |
| 5,876,199 | A | | 3/1999 | Bergersen | |
| 5,882,192 | A | | 3/1999 | Bergersen | |
| 5,911,576 | A | | 6/1999 | Ulrich et al. | |
| 5,975,893 | A | | 11/1999 | Chishti et al. | |
| 6,129,084 | A | | 10/2000 | Bergersen | |
| 6,299,440 | B1 | | 10/2001 | Phan et al. | |
| 6,454,565 | B2 | | 9/2002 | Phan et al. | |
| 6,505,625 | B1 | | 1/2003 | Uenishi | |
| 6,517,567 | B2 | * | 2/2003 | Bass et al. | 606/234 |
| 6,773,451 | B1 | * | 8/2004 | Dussere | 606/235 |
| 2003/0176891 | A1 | * | 9/2003 | Frederic | 606/234 |
| 2005/0080456 | A1 | * | 4/2005 | Sanbrook et al. | 606/235 |
| 2005/0119699 | A1 | * | 6/2005 | Sari | 606/234 |

FOREIGN PATENT DOCUMENTS

| | | | | |
|---|---|---|---|---|
| EP | 0 383 315 | | 2/1990 | |
| WO | WO 00/61065 | * | 10/2000 | 606/234 |
| WO | PCT/US03/29665 | | 9/2003 | |

* cited by examiner

PACIFIER, A SYSTEM AND A METHOD FOR MAINTAINING PROPER DENTITIONS

This application claims the benefit of U.S. Provisional Application Ser. No.: 60/412,454, filed Sep. 20, 2002.

BACKGROUND OF THE INVENTION

The present invention relates to a pacifier, a system and a method for maintaining proper dentitions in a child. More specifically, the present invention relates to one or more pacifiers which may be used to prevent improper guidance of a developing dentition of a child and ease a pain associated with teething.

It is generally known to provide a pacifier to a child. Pacifiers are used by infants and young children as a substitute for sucking instincts the child may develop. However, use of a pacifier often becomes a habit for a child. As a result, use of the pacifier may cause defects in a developing dentition, oral formation or facial appearance of the child.

For example, a child sucking on a pacifier may cause constriction or narrowing of an upper jaw which often results in a cross-bite of the dentition. Another negative effect of pacifier usage may be protrusion of the upper front teeth or a jaw discrepancy. An open bite, speech problems, swallowing problems or temporomandibular joint problems may also be negative effects of pacifier usage.

Passive use of a pacifier, such as, for example, during a period when the deciduous incisors are erupting, may also cause problems, such as, for example, an anterior open bite. If the deciduous anterior open bite is not prevented or treated, a child may also develop a permanent incisal open-bite at six to eight years of age and may develop, for example, abnormal permanent swallowing, breathing and/or speech problems. For a child, a period between an age of eighteen months and six years of age is critical to developing dentitions. Often, a poor pattern of development established during this childhood period causes the child to have a defective adult dentition that is nearly impossible to correct at older ages.

A second problem associated with the use of a pacifier is an occurrence of teething of the child. The child may be frustrated when wearing the pacifier. The pain may discourage the child from wearing the pacifier and may prevent the pacifier from providing a substitute for sucking instincts.

A need, therefore, exists for a pacifier, a system and a method for developing and maintaining proper deciduous dentitions in a child wherein the pacifier guides the incoming deciduous teeth of a child into a normal dentition and a normal pattern of jaw development to create an ideal environment for a later eruption of permanent teeth after six years of age.

SUMMARY OF THE INVENTION

The present invention relates to a pacifier, a system and a method for maintaining proper dentitions in a child. The present invention also relates to a method for relieving a pain associated with teething. The pacifier may have a bulb or false nipple that may be connected to an external shield. A child may suck on the bulb. An isthmus may be provided to connect the bulb and the external shield. The child may bite down on the connecting isthmus. The isthmus may be wider from side-to-side and may extend laterally to encompass erupting deciduous lateral incisors. Moreover, the isthmus may be flat and may have a thickness which may be less than a thickness of connectors associated with known pacifiers.

Because the isthmus extends from the external shield to the bulb or false nipple, the pacifier may prevent the child from developing, for example, an open bite or other malocclusion.

The pacifier may have a thicker cushion at the rear of the isthmus to contact the gums of the child when the pacifier is worn. The isthmus may be sized from front to back to fit between the lips, and may have a cushion or pillow at the rear to put pressure against the gums to relieve the pain associated with teething.

To this end, in an embodiment of the present invention, a pacifier is provided which is worn in a mouth of a user. The pacifier has a shield having a substantially planar body and further having an interior surface directed toward a rear of the mouth of the user when the shield is worn. The pacifier also has a shelf connected to the interior surface of the shield wherein the shelf has a substantially planar body and wherein the shelf is substantially U-shaped. In addition, the pacifier has a bulb attached to the shelf wherein the bulb has a length defined between a first end and a second end wherein the first end is connected to the shelf and the second end extends rearward into the mouth and wherein a perimeter of the bulb at the first end is less than a perimeter of the bulb at the second end.

In an embodiment, the pacifier has a ring attached to the shield.

In an embodiment, the pacifier has lingual tabs integrally formed with the shelf wherein the lingual tabs extend rearward into the mouth of the user.

In an embodiment, the pacifier has walls extending from the shelf wherein the walls contact the interior surface of the shield.

In an embodiment, the pacifier has a depression within the shelf wherein the depression is substantially U-shaped.

In an embodiment, the pacifier has a liquid within the shelf wherein the liquid can be heated or cooled.

In another embodiment of the present invention, a pacifier is provided which is worn in a mouth of a user. The pacifier has a shield having a substantially planar body. The pacifier also has a shelf attached to the shield wherein the shelf is substantially U-shaped and wherein the shelf has a width defined between a first end and a second end wherein a first portion of the shelf between the first end and the second end has a thickness which is less than a first thickness at the first end and a second thickness at the second end.

In an embodiment, the pacifier has a gel stored within the shelf wherein the gel maintains a temperature for the shelf.

In an embodiment, the pacifier has lingual tabs extending from the shelf.

In an embodiment, the pacifier has a second portion between the first end and the second end wherein the second portion is flat.

In an embodiment, the pacifier has an isthmus connecting the shield and the shelf.

In an embodiment, the pacifier has a ring attached to the shield.

In an embodiment, the pacifier has a bulb connected to the shelf wherein the bulb extends rearward into the mouth of the user.

In another embodiment of the present invention, a pacifier is provided which is worn in a mouth of a user.

The pacifier has a shield having a flat surface which contacts a front of the mouth of the user when the shield is worn. The pacifier also has a shelf attached to the surface of the shield wherein the shelf is substantially U-shaped and defines an interior surface. In addition, the pacifier has lingual tabs integrally formed with the shelf along the interior surface wherein each of the lingual tabs have an apex which extends rearward into the mouth of the user.

In an embodiment, the pacifier has a bulb attached to the shelf wherein the bulb has a first end connected to the shelf and a second end wherein the first end has a first thickness which is less than a second thickness at the second end.

In an embodiment, each of the lingual tabs extends downward into the mouth.

In an embodiment, the pacifier has the shelf has a substantially planar body.

In an embodiment, the shield is constructed from a light-absorbent material.

In an embodiment, the shelf has a depression wherein the depression is substantially U-shaped.

In an embodiment, the pacifier has a liquid stored within the shelf wherein the liquid maintains a temperature for the shelf.

It is, therefore, an advantage of the present invention to provide a pacifier, a system and a method for maintaining proper dentitions in a child which may prevent formation of an anterior open bite in a deciduous dentition and subsequently in a permanent dentition.

Another advantage of the present invention is to provide a pacifier, a system and a method for maintaining proper dentitions in a child which may prevent formation of an abnormal swallowing habit by an anterior tongue thrust swallowing pattern.

A further advantage of the present invention is to provide a pacifier, a system and a method for maintaining proper dentitions in a child which may prevent formation of a protruded maxilla (upper jaw) and/or a retruded mandible (lower jaw) and/or a combination of both.

A further advantage of the present invention is to provide a pacifier, a system and a method for maintaining proper dentitions in a child which may prevent formation of a retruded mandible and may not cause a protruded maxilla.

Still another advantage of the present invention is to provide a pacifier, a system and a method for maintaining proper dentitions in a child which may prevent mandibular displacement.

Yet another advantage of the present invention is to provide a pacifier, a system and a method for maintaining proper dentitions in a child which may prevent temporomandibular joint problems.

A further advantage of the present invention is to provide a pacifier, a system and a method for maintaining proper dentitions in a child which may prevent restricted eruption of upper and/or lower incisors.

Another advantage of the present invention is to provide a pacifier, a system and a method for maintaining proper dentitions in a child which may prevent maxillary protrusion and may not cause a retruded mandible.

A further advantage of the present invention is to provide a pacifier, a system and a method for maintaining proper dentitions in a child which may prevent a lack of mandibular growth and/or development.

A still further advantage of the present invention is to provide a pacifier, a system and a method for maintaining proper dentitions in a child which may prevent abnormal speech patterns, namely, lisping caused by improper tongue positions during the pronunciation of fricatives.

Yet another advantage of the present invention is to provide a pacifier, a system and a method for maintaining proper dentitions in a child which may prevent a cross-bite of posterior teeth and/or anterior teeth.

Another advantage of the present invention is to provide a pacifier, a system and a method for maintaining proper dentitions in a child which may prevent excessive lingual inclination of lower anterior teeth.

A further advantage of the present invention is to provide a pacifier, a system and a method for maintaining proper dentitions in a child which may prevent excessive labial inclination of upper anterior teeth.

Another advantage of the present invention is to provide a pacifier, a system and a method for maintaining proper dentitions in a child which may prevent thumb and/or finger sucking and/or other sucking habits.

A further advantage of the present invention is to provide a pacifier, a system and a method for maintaining proper dentitions in a child which may prevent facial deformities.

Another advantage of the present invention is to provide a pacifier, a system and a method for maintaining proper dentitions in a child which may prevent pain during eruption of deciduous incisors.

A further advantage of the present invention is to provide a pacifier, a system and a method for maintaining proper dentitions in a child which may prevent pain during eruption of deciduous canines and/or first molars.

Yet another advantage of the present invention is to provide a pacifier, a system and a method for maintaining proper dentitions in a child which may prevent pain during eruption of deciduous second molars.

Another advantage of the present invention is to provide a pacifier, a system and a method for maintaining proper dentitions in a child wherein a pacifier may be designed to be locatable in a dark environment.

A further advantage of the present invention is to provide a pacifier, a system and a method for maintaining proper dentitions in a child which may prevent abnormal chewing and/or digestion.

And, another advantage of the present invention is to provide a pacifier, a system and a method for maintaining proper dentitions in a child which may prevent abnormal breathing through a mouth of the child.

A further advantage of the present invention is to provide a pacifier, a system and a method for maintaining proper dentitions in a child which may prevent crying and fussing associated with pacifier use and/or teething of the child.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention relates to a pacifier, a system and a method for maintaining proper dentitions in a child. The pacifier may have a bulb which may be connected to an external shield. An isthmus, or connector, may be provided to connect the bulb and the external shield. A child may bite down on the bulb and the connector when the pacifier is worn in the mouth. Known pacifiers may have a rounded connector. However, the isthmus provided in the present invention may be flat and may have a thickness which may be less than a thickness of connectors associated with the known pacifiers. As a result, when a child uses the pacifier of the present invention, the reduced thickness of the isthmus may prevent the child from developing, for example, an open bite or other malocclusion.

Figure 1:
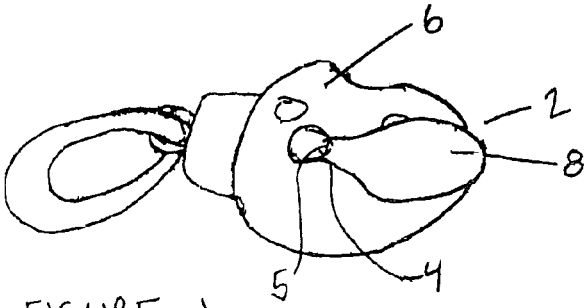
PRIOR ART FIGURE 1
FIG. 1 illustrates a perspective view of a known pacifier.

Referring now to the drawings wherein like numerals refer to like parts, FIG. 1 illustrates a known pacifier 2 which may be used by a child during a period between birth to approximately two to four years of age. The pacifier 2 has a bulb 8 which the child sucks on. The pacifier 2 also has an external shield 6 connected to the bulb 8 by a rounded connector 4 which the child often bites upon.

The pacifier 2 may prevent a child from sucking habits, such as, for example, placing fingers or a thumb within the mouth. Between the age of six months and nine months, the first deciduous incisors of the child, specifically the upper and lower centrals, may begin to erupt. However, use of the pacifier 2 may stop the first deciduous incisors from fully erupting into the mouth due to a thickness 5 of the rounded connector 4. Upper lateral deciduous incisors and lower lateral deciduous incisors may erupt from a time period between the ages of nine month and twelve months. Use of the pacifier 2 may also stop the upper lateral deciduous incisors and the lower lateral deciduous incisors from erupting completely, and from assuming an upright position caused by the rounded connector 4.

At a time when a child is eighteen months old, the upper deciduous canines and the lower deciduous canines and/or the first deciduous molars erupt and are allowed to erupt more completely without any interference because of an absence of the connector 4 present between the upper canines and the lower canines and molars. If the connector 4 is present in the pacifier 2, the connector may interfere with eruption of the upper incisors and the lower incisors. Therefore, the canines and the molars erupt more completely than the incisors which enhance an anterior open bite. As a result, a child using the pacifier 2 of FIG. 1 may have an anterior open bite 52, such as that illustrated in FIG. 5A. Prolonged use of the pacifier 2 may also prevent the lower jaw from developing in a forward direction. A child may then have a facial profile 141, illustrated in FIG. 4A, wherein a jaw relation 142 may have a protrusion of the upper front teeth. Moreover, the jaw relation 142 may have a jaw discrepancy where the upper and lower jaws have a greater distance between them than should normally be present in a normal jaw relation 146, illustrated in FIG. 4B. The discrepancy may be the result of a forward position of the upper jaw, or a rearward position of the lower jaw, or any combination of both.

Figure 14A:
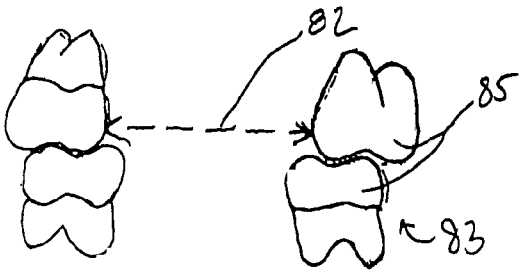
FIG. 14A illustrates a cross-sectional view at the molars of a child having a normal width of an upper jaw.

Use of the pacifier 2 may cause an abnormal relation between the upper jaw and the lower jaw at a time when the canines and/or the first deciduous molars of the child erupt into place. The abnormal jaw relation 142 may be referred to as a Class II jaw relation 142. The canines and/or first deciduous molars may erupt, settle into place and become intercuspated. As a result, the child may have a receded lower jaw relation with the upper jaw. The receded lower jaw relation remains consistent throughout the life of the child and through adulthood unless corrected by orthodontics or surgery. Use of the pacifier 2 may also cause constriction or a narrowing width 80 of the upper jaw, as shown by occlusion 81 in FIG. 14B. Narrowing of the upper jaw may result in a cross-bite 84 of the dentition of the child. A normal bite 83 of molars 85 with a normal arch width 82 is illustrated in FIG. 14A.

Figure 2:
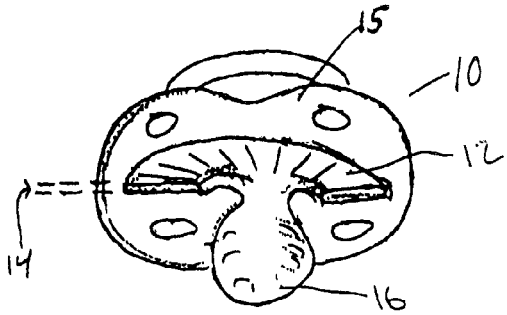
FIG. 2 illustrates a perspective view of a pacifier in an embodiment of the present invention.

FIG. 2 illustrates a pacifier 10 of the present invention. The pacifier 10 may be used by the child, for example, at the age of six months. The pacifier 10 may serve as a replacement for the pacifier 2 illustrated in FIG. 1. The pacifier 10 may have a shelf 12 which may have a thickness 14. In an embodiment, the thickness 14 may be equal or thinner than the thickness 5 of the connector 4 of the pacifier 2 illustrated in FIG. 1.

Figure 3:
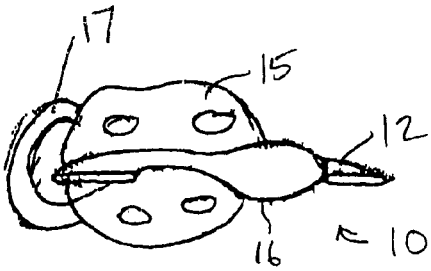
FIG. 3 illustrates a side perspective view of the pacifier of FIG. 2.

Preferably, the thickness 14 of the shelf 12 is less than the thickness 5 of the connector 4. FIG. 3 illustrates a side perspective view of the pacifier 10. The shelf 12 may control eruption of the upper deciduous central incisors and the lateral incisors and/or the lower deciduous central incisors and the lateral incisors of the child from an age of, for example, six months to eighteen months.

In an embodiment, an external shield 15 of the pacifier 10 may be identical in shape to the external shield 6 of the pacifier 2. In addition, a nipple or a bulb 16 of the pacifier 10 may be similar in shape, although not necessarily identical in shape, to the nipple or bulb 8 of the pacifier 2. As a result, the pacifier 10 may have a similar feel within the mouth of the child as 1o the pacifier 2.

Figure 5A:
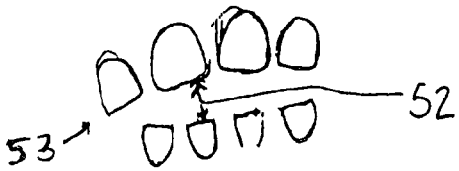
FIG. 5A illustrates a front occlusal view of a child having an anterior open bite.
Figure 5B:
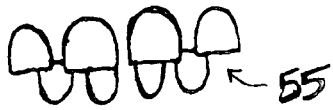
FIG. 5B illustrates a front occlusal view of a child having a normal dentition.
Figure 7:
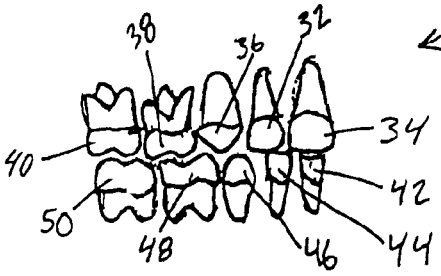
FIG. 7 illustrates a side occlusal view of upper teeth and lower teeth of a child.

In an embodiment, the shelf 12 may be connected to the external shield 15 and may extend distally into or to the rear of the mouth of the child. The shelf 12 may or may not cover erupting deciduous lateral incisors 32, 44 and/or central incisors 34, 42, as illustrated in FIG. 7. The shelf 12 may prevent the incisors 34, 42, 32, and 44 of the child from erupting unequally into the mouth, providing a dentition 53 as illustrated in FIG. 5A. The open bite 52 of FIG. 5A may develop as a result of preventing the incisors 34, 42, 32, 44 from fully erupting. When the shelf 12 is part of the improved design, the shelf 12 may allow all eight incisors 34, 42, 32, 44 to erupt equally with a normal relation, as illustrated by a dentition 55 in FIG. 5B.

Figure 4A:
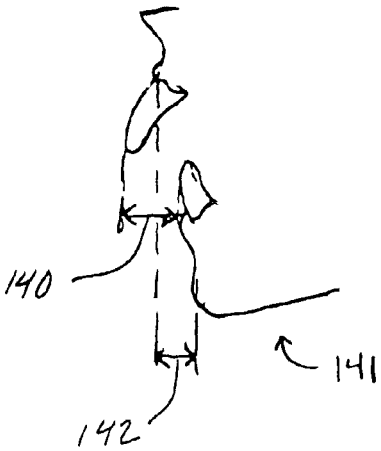
FIG. 4A illustrates a side view of a facial profile in an improper dentition.
Figure 4B:
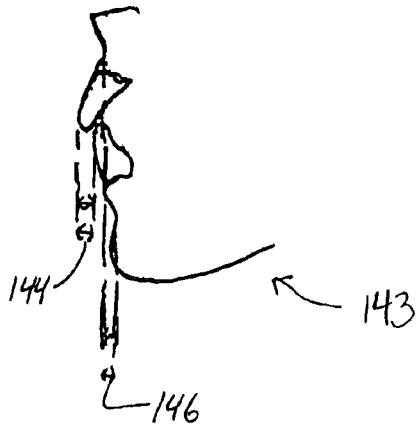
FIG. 4B illustrates a side view of a facial profile in a normal dentition.

The pacifier 10 may enable full and even eruption of the deciduous central incisors 34, 42 and the lateral incisors 32, 44. Moreover, the pacifier 10 may begin to advance the mandible, or lower jaw, into a more normal Class I jaw relation 146 with the upper jaw. Such a jaw relation 146 is generally illustrated in FIG. 4B. An abnormal jaw relation 142 is illustrated in FIG. 4A. The pacifier 10 may also enable incisors 34, 42, 32, 44 to erupt more normally, without being displaced. For example, the upper incisors 34, 32 may be guided forward and the lower incisors 42, 44 may be guided rearward, as illustrated by the facial profile 141 and abnormal dental relation 140. Moreover, use of the pacifier 10 may provide a normal width 82 with a normal width relation 85 of the molars of the upper jaw, as generally illustrated by occlusion 83 in FIG. 14A.

Figure 6:
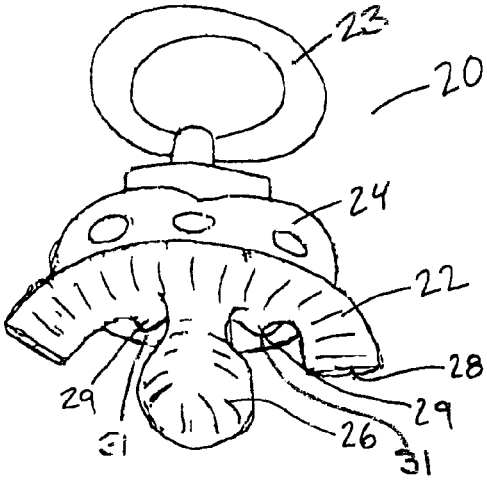
FIG. 6 illustrates a perspective view of a pacifier in an embodiment of the present invention.
Figure 8:
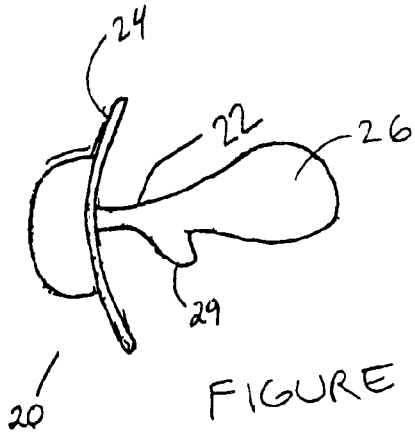
FIG. 8 illustrates a side view of a pacifier in an embodiment of the present invention.

FIG. 6 illustrates a pacifier 20 which may be used by the child after the child reaches, for example, approximately eighteen months of age. At this time, upper deciduous canines 36 and lower deciduous canines 46 and/or first deciduous molars 38, 48 (illustrated in FIG. 7) may begin to erupt into the mouth. The pacifier 20 may have an external shield 24 which may be similar in size and/or shape to the external shield 6 of the pacifier 2 and/or the external shield 15 of the pacifier 10. The pacifier 20 may or may not have a nipple or bulb 26 which may or may not be similar in shape or size to the bulb 8 of the pacifier 2 and/or the bulb 16 of the pacifier 10. FIG. 8 illustrates a cross-sectional view of the pacifier 20. A shelf 22 may be shaped to extend distally to the rear of the mouth of the child when the pacifier 20 is worn. The shelf 22 may accommodate and control an extent of the eruption of the upper deciduous canines 36 and the lower deciduous canines 46 and/or the deciduous first molars 38, 48 as illustrated in FIG. 7.

The pacifier 20 of FIG. 6 may have lower lingual tabs 29 to aid in maintaining the lower jaw, or mandible, in an advanced position while the deciduous canines and first molars erupt. The lingual tabs 29 may form an apex 31. The teeth of the child may then obtain an ideal intercuspation 30 as illustrated in FIG. 7. Moreover, the pacifier 20 may assist in maintaining jaw advancement toward the Class I relation 146 and toward a normal tooth relation 144, both illustrated in FIG. 4B. The lingual tabs 29 may or may not be present in pacifier 10 of FIG. 2. The lingual tabs 29 are illustrated in FIG. 8, which is a cross section along the line B-B.

Figure 9A:
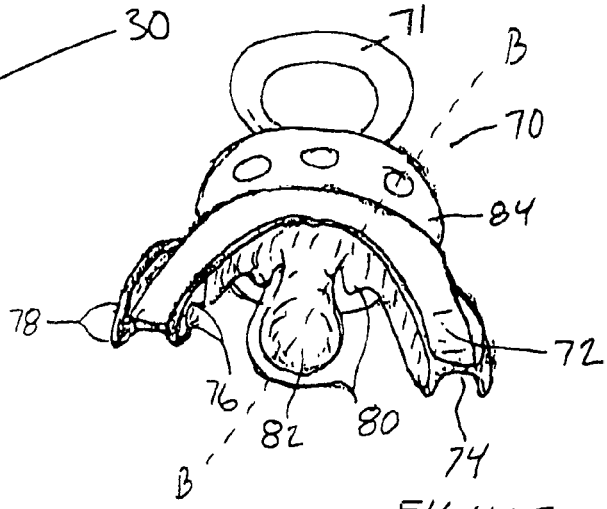
FIG. 9A illustrates a perspective view of a pacifier in an embodiment of the present invention.

FIG. 9A illustrates a pacifier 70 which may be used by the child when the child reaches an age of, for example, approximately 24 to 36 months of age. During this period, upper second deciduous molar 40 and/or lower second deciduous molar 50 (illustrated in FIG. 7) may erupt into place. The pacifier 70 may have a shelf 72 which may be shaped to extend distally towards the rear of the mouth of the child when worn. As a result, the pacifier 70 may control the eruption of the upper second deciduous molar 40 and/or the lower second deciduous molar 50.

Figure 14B:
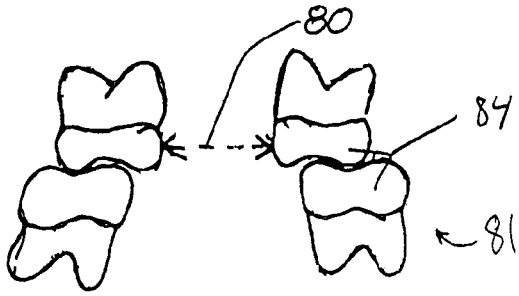
FIG. 14B illustrates a cross-sectional view at the molars of a child having a narrow width of an upper jaw.

The pacifier 70 may have a lingual shield 76 which may assist in guiding the posterior molars 38, 40, 48, 50 into a proper occlusion and/or may assist in correcting a posterior cross-bite 81, such as that illustrated in FIG. 14B. The posterior cross-bite 81 may be caused by prolonged sucking of the known pacifier 2 of FIG. 1 which may draw the upper molars 38, 40 together and narrows the upper arch 80 to produce a molar cross-bite 84. The pacifier 70 may also have a shield 78 (at a buccal location of the pacifier 70 when the pacifier 70 is worn) to control the eruption and/or position of the upper posterior deciduous teeth 38, 40 and the lower posterior deciduous teeth 48, 50.

In an embodiment, the pacifier 70 may have lingual tabs 80. In addition, the pacifier 70 may or may not have a nipple or bulb 82 which may be similar in size and/or shape to the bulb 8 of the pacifier 2, the bulb 16 of the pacifier 10, or the bulb 26 of the pacifier 20. The pacifier 70 may or may not have an exterior shield 84 which may be similar in size and/or shape to the exterior shield 6 of the pacifier 2, the exterior shield 15 of the pacifier 10, or the exterior shield 24 of the pacifier 20. The pacifiers 10, 20 and 70 may be constructed from a single material or a combination of materials, such as, for example, latex, silicone, polyvinyl chloride, polypropylene, or the like.

The pacifier 70 may be worn prior to the use of, for example, a Nite-Guide™ and/or Occlus-O-Guide™ preformed appliance, manufactured by ORTHOTAIN, Inc. The Nite-Guide™ and/or Occlus-O-Guide™ appliance does not have an exterior shield or a bulb and does not resemble a pacifier. In an embodiment, the shield 84 and the bulb 82 of the pacifier 70 may be reduced significantly or eliminated completely in preparation for the child to accept the preformed Nite-Guide™ and/or Occlus-O-Guide™ appliance. The Nite-Guide™ and/or Occlus-O-Guide™ appliance may straighten the teeth and further improve jaw relations if needed or required.

In general, children at an age of approximately six months to ten months may suffer pain when the deciduous central incisors 34, 42 and lateral incisors 32, 44 erupt through tissue. Children may also experience pain during a period from twelve months to twenty months of age when the deciduous canines 36, 46 and the first molars 38, 48 erupt. In addition, children may experience pain during a period between eighteen months to twenty-four months when the second deciduous molars 40, 50 erupt.

Figure 9B:
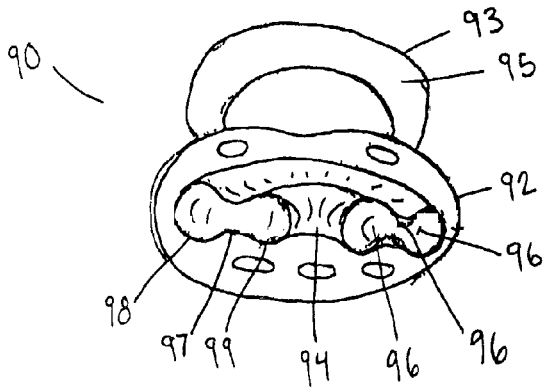
FIG. 9B illustrates a perspective view of a pacifier/teething appliance in an embodiment of the present invention.

FIG. 9B illustrates a pacifier and/or teething appliance 90 which may assist in reducing the pain experienced by children in the age range of about six months to twenty-four months. The pacifier and/or teething appliance 90 may have an exterior shield 92 which may be shaped similarly to the exterior shield 6 of the pacifier 2, the exterior shield 15 of the pacifier 10, the exterior shield 24 of the pacifier 20, or the exterior shield 84 of the pacifier 70. Further, the pacifier 90 may have a shelf 94 which may have a shape of a soft shaped pillow 94 comprised of an enlarged labial area 98 and an enlarged lingual area 94. The pillow 94 may also have a depressed or narrow area 97 between the labial area 98 and the lingual area 99. This depressed middle area 97 may guide the teeth 34, 42, 32, 44, 36, 46, 38, 48, 40 and 50 into the mouth in a proper labio-lingual and bucco-lingual position and prevents an occurrence of cross-bite. This shelf 94 may be shaped like a pillow and may surround the entire gum area where the incisors 34, 42, 32, 44 are erupting and causing pain. In an embodiment, the pillow 94 may not have the depression 97, or center constriction, but may remain straight in shape from the labial area 98 to the lingual area 99.

Figure 10:
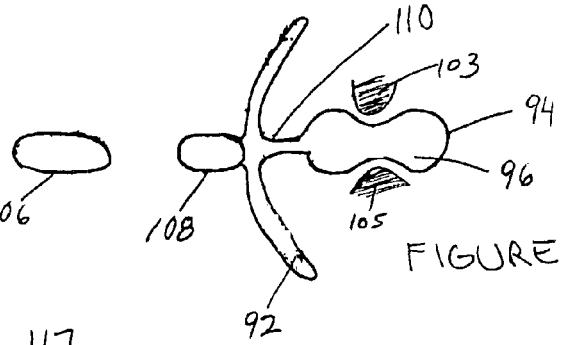
FIG. 10 illustrates a cross-sectional view of the pacifier and/or teething appliance of FIG. 9B.

The pillow 94 may have an interior 96 which may be filled with, for example, a gel or liquid that may be cooled. The gel or liquid may be of a type which may retain a cool temperature. In an embodiment, the gel or liquid may contain a sterile broth or like material. FIG. 10 illustrates a cross-sectional view of the pacifier 90. An isthmus 110 may connect the shield 92 and the soft pillow 94 and may surround upper arch 103 and lower arch 105. In an embodiment, the pillow 94 may not be hollow and may not contain a liquid or gel within the interior 96 but may be constructed from a solid material. A ring 93 may be attached to the pacifier 90 and may be constructed from a material wherein the material enables the ring 93 to be located in a dark environment. Moreover, any of the pacifiers 10, 20, 70, 90 and/or the rings 17, 23, 71, 93 and 117 may be constructed from a material which may enable the pacifiers 10, 20, 70, 90 and 110 to be located in a dark environment.

Figure 11:
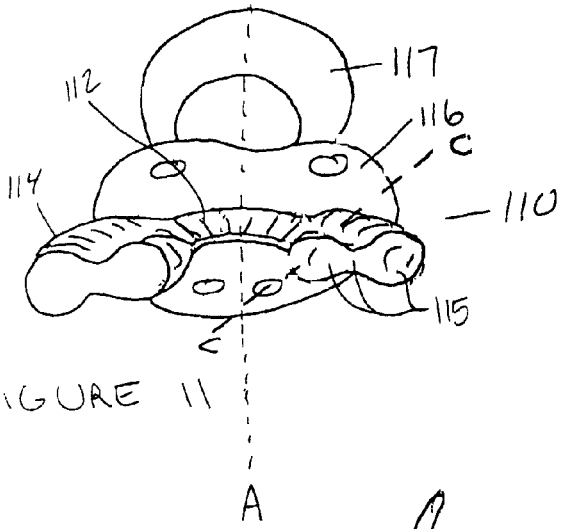
FIG. 11 illustrates a perspective view of a pacifier and/or teething appliance in another embodiment of the present invention.

FIG. 11 illustrates a pacifier 110 which may be used by a child that may be experiencing pain as a result of erupting deciduous canines 36, 46 and first deciduous molars 38,48. The pacifier 110 may have a flat shelf 112 to receive erupted upper incisors 32, 34 and lower incisors 42, 44. In addition, the pacifier 110 may have a pillow area 114 to provide relief to the upper gum tissue and the lower gum tissue for erupting deciduous canines 36, 46 and/or first deciduous molars 38, 48. The pillow 114 may be constructed from plastic or like material. The pillow 114 may have an interior 115 which may be filled with, for example, a liquid or gel. The liquid or gel and/or the shape of the pillow may enable the pillow 114 to adapt to a shape of the gum tissue.

The pacifier 110 may have an external shield 116. In an alternate embodiment, the external shield 116 may not be present, and a retention ring 132, 130 may be attached directly to a teething arch 128, illustrated in cross-section along the line A-A in FIG. 12C. The retention ring 130 and 132 may be attached by a hinge 131 to the teething arch 128.

Figure 12A:
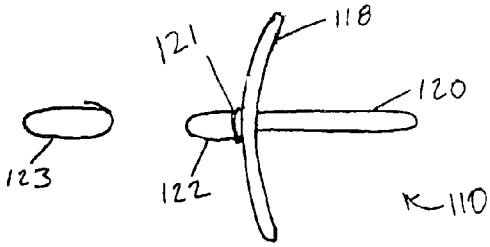
FIG. 12A illustrates a cross-sectional view of a dental appliance and/or teething appliance in an embodiment of the present invention along the line A-A.

FIG. 12A illustrates a cross-sectional view along the line A-A of the pacifier 110 at the midline of the child. The external shield 118 may be attached to the teething arch 120 and also to the retention ring 122, 123 by a hinge 121. The external shield 116, 118, 92, 24, 15, 84 may protect the child from gagging by preventing any pacifier and/or teething arch from slipping back into the throat and/or may help to maintain a position of the pacifier and/or teething arch 110 within the mouth. A first teething arch may be used by the child to relieve pain from teething. During use of the first teething arch, a second, duplicate or similar teething arch may be cooled. The second teething arch may be used by the child after the first teething arch has become warm.

Figure 12B:
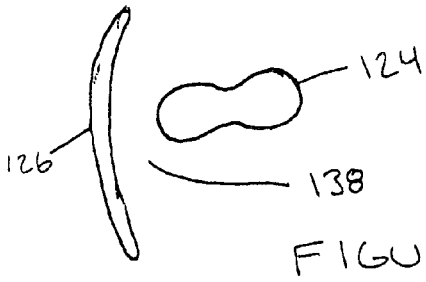
FIG. 12B illustrates a cross-sectional view of a pacifier and/or teething appliance in an embodiment of the present invention along the line C-C.
Figure 12C:
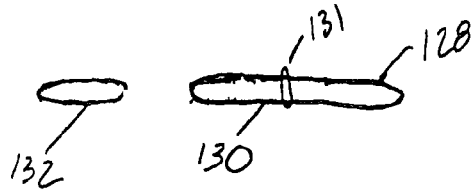
FIG. 12C illustrates a cross-sectional view of a pacifier and/or teething appliance in an embodiment of the present invention at a midline.

In an embodiment, the shelf 112 may be shaped to extend further into the mouth. The shelf 112 may allow the erupted deciduous central 34, 42 and lateral 32, 44 incisors, as well the deciduous canines 36, 46 and first deciduous molars 38, 48 to be in contact with the shelf 140. Further, the pillows 114 present in appliance 110 may be positioned further distally to cover the gum tissue in the area of the second deciduous molars 40, 50. The pillow 114 of appliance 110 of FIG. 11 may be separated from the external shield 116, as illustrated in cross-section taken along line C-C in FIG. 12B. As further illustrated in FIG. 12B, the pillow 124 may cover the canines 36, 46 and the first molars 38, 48 may be separated from the external shield 126 by a space 138 to allow the lips and/or cheeks of the child to be present without interference.

Figure 13:
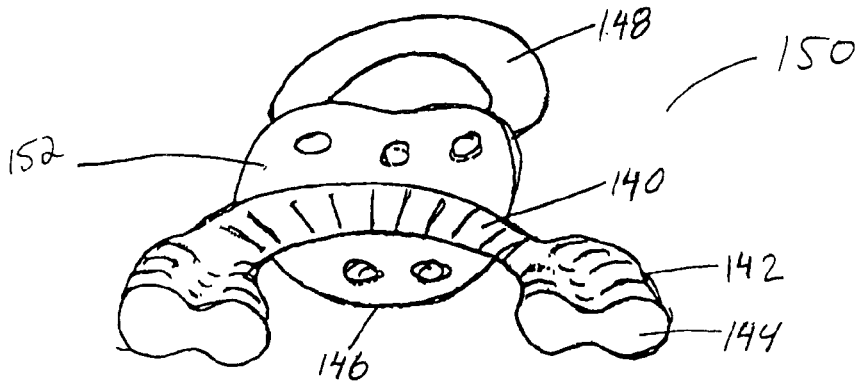
FIG. 13 illustrates a perspective view of a pacifier and/or teething appliance in an embodiment of the present invention.

FIG. 13 illustrates a pacifier 150 having a pillow 142 which may be positioned further towards the rear of the mouth when the pacifier/teething appliance 150 is worn. As a result, the pillow 142 may allow the pain from the erupting second deciduous molars 40, 50 to be relieved. A shelf 140 may maintain the other teeth 34, 42, 32, 44, 36, 46, 38, 48 in their normal position. A flat isthmus 140 may be attached directly to an external shield 152 at the midline or directly to a retention ring 148 directly.

The pacifiers 10, 20, 70, 90, 110, 150 may be used by a child as part of a pacifier system to coincide with development of different tooth groups in the mouth of the child and/or as teething appliances to relieve pain. The child may, for example, wear the pacifier 10 at any age after birth. A teething pad 94 may be incorporated into pacifier 10 to relieve pain and discomfort from the eruption of the incisors 34, 42, 32, 44 (not shown).

Figure 15:
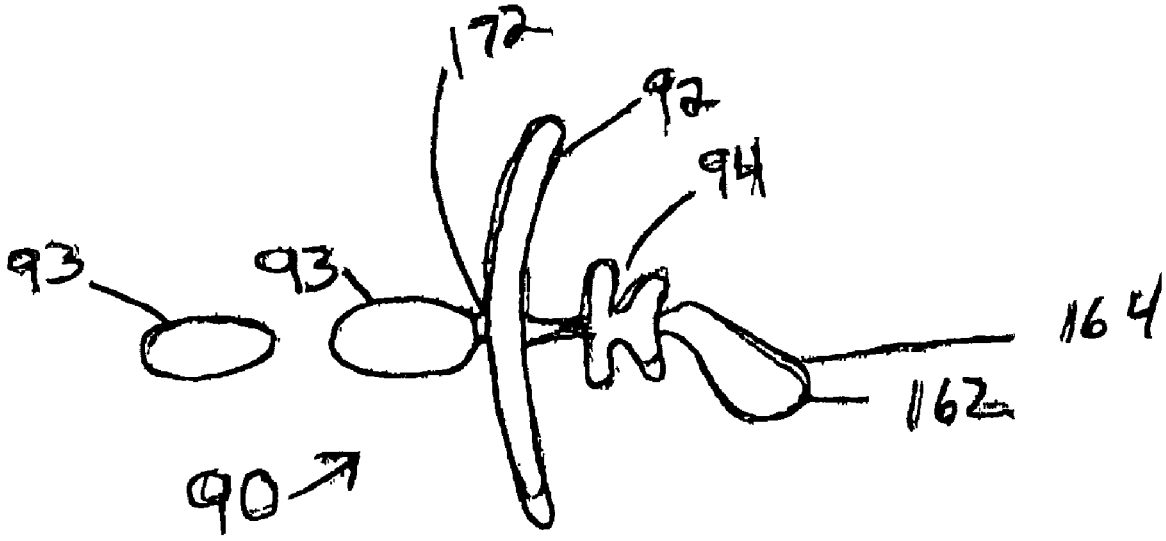
FIG. 15 illustrates a cross-sectional view of a pacifier and/or teething appliance in an embodiment of the present invention.

FIG. 15 illustrates a cross-sectional view of the pacifier 90 of FIG. 9B. In an embodiment, the pillow 94 may be shaped to receive the incisors 34, 42, 32, 44. In addition, the pillow 94 may be used as a combination pacifier and/or teething appliance and may have a bulb 162. The bulb 162 or any of the bulbs 16, 26, and 82 may be slanted downward to encourage the tongue to be elevated toward the palette to prevent a cross-bite 84 from developing in the patient. A top 164 of the bulb 162 may be flattened for the same effect, namely, preventing a cross-bite 84 from occuring. In an embodiment, the external shield 92 may be connected to the retention ring 93 by a hinge 172.

The child may, for example, wear the pacifier 10 at an age of nine months, when the first deciduous incisors of the child may erupt. The child may then, for example, wear the pacifier 20 at an age of eighteen months, when the upper deciduous canines and the lower deciduous canines and/or the first deciduous molars may erupt. The child may then, for example, wear the pacifier 70 at an age of twenty-four to thirty-six months, when the upper second deciduous molar and/or the lower second deciduous molar may erupt.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A pacifier sized to be worn in a mouth of a user, the pacifier comprising:

a shield having a substantially planar body;

a shelf attached to the shield wherein the shelf has a first end, a second end located opposite to the first end and a midline located in the middle of the first end of the shelf and the second end of the shelf wherein the midline of the shelf is adjacent to the shield wherein the first end of the shelf and the second end of the shelf extend rearward with respect to the mouth of the user when the shelf is worn in the mouth of the user wherein the shelf is substantially U-shaped and wherein the shelf has a width defined between an upper side of the shelf and a lower side of the shelf wherein the width at the first end of the shelf and the second end of the shelf is thicker than the width at the midline of the shelf; and a depression within the top side of the shelf and the bottom side of the shelf wherein the depression is substantially U-shaped.

2. The pacifier of claim 1 further comprising: a gel stored within the shelf wherein the gel maintains a temperature for the shelf.

3. The pacifier of claim 1 further comprising:

lingual tabs extending from the shelf.

4. The pacifier of claim 1 further comprising:

a second portion located between the first end of the shelf and the second end of the shelf wherein the second portion is flat between the first end of the shelf and the second end of the shelf.

5. The pacifier of claim 1 further comprising:
an isthmus connecting the shield and the shelf.

6. The pacifier of claim 1 further comprising:
a ring attached to the shield.

7. The pacifier of claim 1 further comprising:
a bulb connected to the shelf wherein the bulb extends rearward into the mouth of the user when the shelf is worn in the mouth of the user.

8. A pacifier sized to be worn in a mouth of a user, the pacifier comprising:
a shield having a flat surface which contacts a front of the mouth of the user when the shield is worn in the mouth of the user;
a shelf attached to the flat surface of the shield wherein the shelf has a length defined between a first end of the shelf and a second end of the shelf wherein the shelf has a width defined between a first side of the shelf and a second side of the shelf wherein the first side of the shelf is connected to the shield wherein the shelf has a thickness defined between a top side of the shelf and a bottom side of the shelf wherein the shelf is substantially U-shaped and defines an interior surface wherein the thickness of the shelf between the top side of the shelf and the bottom side of the shelf is uniform and continuous between the first side of the shelf and the second side of the shelf and from the first end of the shelf to the second end of the shelf; and
lingual tabs integrally formed with the shelf along the interior surface wherein each of the lingual tabs have an apex which extends rearward into the mouth of the user when the shelf is worn in the mouth of the user and further wherein the lingual tabs extend outwardly with respect to the bottom side of the shelf.

9. The pacifier of claim 8 further comprising:
a bulb attached to the shelf wherein the bulb has a first end connected to the shelf and a second end wherein the first end has a first thickness which is less than a second thickness at the second end.

10. The pacifier of claim 8 wherein each of the lingual tabs extends posteriorly or rearward into the mouth of the user when the shelf is worn in the mouth of the user.

11. The pacifier of claim 8 wherein the shelf has a substantially planar body.

12. The pacifier of claim 8 wherein the shield is constructed from a material which is locatable in a dark environment.

13. The pacifier of claim 8 wherein the shelf has a depression wherein the depression is substantially U-shaped.

14. The. Pacifier of claim 8 further comprising:
a liquid stored within the shelf wherein the liquid maintains a temperature for the shelf.

15. A pacifier sized to be worn in a mouth of a user having teeth and gum tissue, the pacifier comprising:
a shelf having a length defined between a first end of the shelf and a second end of the shelf wherein the shelf is generally U-shaped wherein the shelf has a width defined between a first side of the shelf and a second side of the shelf wherein the first end of the shelf and the second end of the shelf have a depression located between the first side of the shelf and the second side of the shelf wherein the shelf has a first thickness located between the first end of the shell and the second end of the shell wherein the shelf has a second thickness located at the depression of the first end of the shelf and the second end of the shelf wherein the second thickness of the shelf is greater than the first thickness of the shelf and further wherein the first side of the shelf and the second side of the shelf are bulbous.

16. The pacifier of claim 15 further comprising:
a bulb attached to the second side of the shelf.

17. The pacifier of claim 15 further comprising:
a shield attached to the first side of the shelf.

18. The pacifier of claim 15 wherein a portion of the shelf is flat wherein the portion of the shelf is located between the first end of the shelf and the second end of the shelf.

19. The pacifier of claim 15 wherein the length of the shelf is sized to receive the teeth of the user when the shelf is worn in the mouth of the user.

20. The pacifier of claim 15 further comprising:
a ring connected to the shelf wherein the ring is adjacent to the first side of the shelf.

21. The pacifier of claim 15 further comprising:
lingual tabs attached to the second side of the shelf.

22. The pacifier of claim 15 further comprising:
walls integrally formed with the shelf wherein the walls guide the teeth of the user when the shelf is worn in the mouth of the user.

23. The pacifier of claim 15 further comprising:
a gel located inside the shelf wherein the gel maintains a temperature for the shelf.

24. The pacifier of claim 15 wherein the shelf is made from a material which is locatable in a dark environment.

25. The pacifier of claim 15 wherein the first side of the shelf and the second side of the shelf with the depression between the first side of the shelf and the second side of the shelf surround the gum tissue in the mouth of the user when the shelf is worn in the mouth of the user.

26. A pacifier sized to be worn in a mouth of a user having teeth and gust tissue, the pacifier comprising:
a shelf having a length defined between a first end of the shelf and a second end of the shelf wherein the shelf is generally U-shaped wherein the shelf has a width defined between a first side of the shelf and a second side of the shelf wherein the shelf has a top side of the shelf and a bottom side of the shelf located opposite to the top side wherein the top side of the shelf has a first area located between the first side of the shelf and the second side of the shelf wherein the first area on the top side of the shelf defines a first depression on the top side of the shelf wherein the first area and the first depression extend from the first end of the shelf to the second end of the shelf wherein the bottom side of the shelf has a second area located between the first side of the shelf and the second side of the shelf wherein the second area on the bottom side of the self defines a second depression on the bottom side of the shelf wherein the second area and the second depression extend from the first end of the shelf to the second end of the shelf wherein the shelf has a first thickness between the top side of the shelf and the bottom side of the shelf at the first side of the shelf and the second side of the shelf wherein the shelf has a second thickness between the first depression on the top side of the shelf and the second depression on the bottom side of the shelf wherein the second thickness is less than the first thickness and further wherein the first side and the second side are bulbous.

27. The pacifier of claim 26 further comprising:
a lingual tab extending outwardly with respect to the bottom side of the shelf.

28. The pacifier of claim 26 further comprising:

a gel located inside the shelf wherein the gel maintains a temperature for the shelf.

29. The pacifier of claim 26 further comprising:

a ring attached to the shelf wherein the ring is adjacent to the first side of the shelf.

30. The pacifier of claim 26 further comprising:

a bulb extending outwardly with respect to the second side of the shelf.

31. A method for maintaining proper dentition in a mouth of a user wherein the proper dentition of the user at a first age is a first dentition and further wherein the proper dentition of the user at a second age is a second dentition wherein the second age of the user is greater than the first age of the user, the method comprising the steps of:

providing a first pacifier sized to be worn in the a mouth of the user at the first age wherein the first pacifier has a first shelf and a first ring attached to a first shield wherein the first shield is located between the first shelf and the first ring wherein the first shelf is generally U-shaped and has a first length of the first shelf defined between a first end of the first shelf and a second end of the first shelf wherein a first bulb is attached to the first shelf wherein the first bulb extends toward a rear of the mouth of the user when the first pacifier is worn in the mouth of the user at the first age and further wherein the first shelf contacts teeth of the user when the first pacifier is worn in the mouth of the user at the first age; and providing a second pacifier sized to be worn in the mouth of the user at the second age wherein the second pacifier has a second shelf and a second ring attached to a second shield wherein a second bulb is attached to the second shelf wherein the second shelf has a second length defined between a first end of the second shelf and a second end of the second shelf wherein the second length of the second shelf is greater than the first length of the first shield and the second bulb of the second pacifier is a smaller bulb than the first bulb of the first pacifier wherein the second bulb extends toward the rear of the mouth of the user when the second pacifier is worn in the mouth of the user at the second age and further wherein the second shelf contacts teeth of the user when the second pacifier is worn in the mouth of the user at the second age.

32. The method of claim 31 further comprising the step of:

providing an extension of the second shelf or a third shelf to be worn in the mouth of a user.

33. The method of claim 31 further comprising the step of:

attaching a lingual tab to the first shelf and the second self.

34. The method of claim 31 further comprising the step of:

providing a gel within the first shelf and the second shelf.

35. A pacifier sized to be worn in a mouth of a user, the pacifier comprising:

a shield having a substantially planar body end further having an interior surface directed toward a rear of the mouth of the user when the shield is worn adjacent to the mouth of the user;

a shelf connected to the interior surface of the shield wherein the shelf is sized to be worn in the mouth of the user wherein the shelf has a length defined between a first end of the shelf and a second end of the shelf wherein the shelf has a top side of the shelf and a bottom side of the shelf wherein the top side of the shelf is located opposite to the bottom side of the shelf wherein the shelf has a width defined between a first side of the shelf and a second side of the shelf wherein the first side of the shelf is adjacent to the interior surface of the shield wherein the shelf abuts the interior surface of the shield wherein the top side of the shelf is planar and flat with respect to the bottom side of the shelf between the first side of the shelf and the second side of the shelf and from the first end of the shelf to the second end of the shelf and further wherein the shelf is substantially U-shaped;

a bulb attached to the shelf wherein the bulb has a length defined between a first end and a second end wherein the first end is connected to the shelf and the second end extends rearward into the mouth when the shelf is worn in the mouth of the user wherein a perimeter of the bulb at the first end is less than a perimeter of the bulb at the second end and further wherein the second end of the bulb extends downward with respect to the first end of the bulb when the shelf is worn in the mouth of the user; and lingual tabs integrally formed with the shelf wherein the lingual tabs extend rearward into the mouth of the user.

36. A pacifier sized to be worn in a mouth of a user, the pacifier comprising:

a shield having a substantially planar body and further having an interior surface directed toward a rear of the mouth of the user when the shield is worn adjacent to the mouth of the user;

a shelf connected to the interior surface of the shield wherein the shelf is sized to be worn in the mouth of the user wherein the shelf has a length defined between a first end of the shelf and a second end of the shelf wherein the shelf has a top side of the shelf and a bottom side of the shelf wherein the top side of the shelf is located opposite to the bottom side of the shelf wherein the shelf has a width defined between a first side of the shelf and a second side of the shelf wherein the first side of the shelf is adjacent to the interior surface of the shield wherein the shelf abuts the interior surface of the shield wherein the top side of the shelf is planar and flat with respect to the bottom side of the shelf between the first side of the shelf and the second side of the shelf and from the first end of the shelf to the second end of the shelf and further wherein the shelf is substantially U-shaped;

a bulb attached to the shelf wherein the bulb has a length defined between a first end and a second end wherein the first end is connected to the shelf and the second end extends rearward into the mouth when the shelf is worn in the mouth of the user wherein a perimeter of the bulb at the first end is less than a perimeter of the bulb at the second end and further wherein the second end of the bulb extends downward with respect to the first end of the bulb when the shelf is worn in the mouth of the user; and lingual tabs attached to the second side of the shelf.

37. A pacifier sized to be worn in a mouth of a user having teeth and gum tissue, the pacifier comprising:

a shelf having a length defined between a first end of the shelf and a second end of the shelf wherein the shelf is generally U-shaped wherein the shelf has a width defined between a first side of the shelf and a second side of the shelf wherein the shelf has a top side of the shelf and a bottom side of the shelf located opposite to the top side of the shelf wherein the top side of the shelf and the bottom side of the shelf have a depression which is defined between the first side of the shelf and the second side of the shelf on the top side of the shelf and the bottom side of the shelf wherein the depression on the top side of the shelf and the bottom of the shelf extends from the first end of the shelf to the second end of the shelf wherein the first side of the shelf and the second side of the shelf have a first thickness defined between the top side of the shelf and the bottom side of the shelf wherein the shelf has a second thickness at the depression defined between the top side of the shelf and the bottom side of the shelf wherein the second thickness is less than the first thickness and further wherein the shelf is made from a material which is locatable in a dark environment; and a lingual tab extending from the shelf.

* * * * *